US012247393B2

(12) United States Patent
Babineau, Jr.

(10) Patent No.: US 12,247,393 B2
(45) Date of Patent: Mar. 11, 2025

(54) COMPOSITE FRAMING MEMBER COMPRISING ELEMENTS THAT PROVIDE A THERMAL BREAK

(71) Applicant: JOHNS MANVILLE, Denver, CO (US)

(72) Inventor: Francis John Babineau, Jr., Parker, CO (US)

(73) Assignee: Johns Manville, Denver, CO (US)

( * ) Notice: Subject to any disclaimer, the term of this patent is extended or adjusted under 35 U.S.C. 154(b) by 178 days.

(21) Appl. No.: 17/994,873

(22) Filed: Nov. 28, 2022

(65) Prior Publication Data

US 2024/0175255 A1 May 30, 2024

(51) Int. Cl.
*E04B 1/76* (2006.01)
*E04B 1/80* (2006.01)

(52) U.S. Cl.
CPC ..... *E04B 1/7604* (2013.01); *E04B 1/80* (2013.01)

(58) Field of Classification Search
CPC ..... E04B 1/4171; E04B 1/40; E04B 1/7629; E04B 1/66; E04B 1/7604; E04B 1/80; E04B 1/7608; E04B 1/7612; E04B 1/762; E04B 1/7633; E04B 1/7637; E04B 2002/0245; E04B 2002/0202; E04B 2002/0243; E04B 2002/565; E04B 2/58; E04B 2/70; E04B 2/707
See application file for complete search history.

(56) References Cited

U.S. PATENT DOCUMENTS 11,142,904 B2 * 10/2021 Miks ..... E04B 1/762
2010/0236172 A1 * 9/2010 Wirth ..... E04B 1/26 52/309.4
2020/0157799 A1 * 5/2020 Cervini ..... E04B 1/74

* cited by examiner

*Primary Examiner* — Mark R Wendell
(74) *Attorney, Agent, or Firm* — Robert D. Touslee

(57) ABSTRACT

A framing assembly may include a plurality of framing members that are coupled together to form a cavity. Each of the plurality of framing members may include a structural member. The structural member may include a lateral surface extending along a length of the structural member. The structural member may include an exterior-facing surface extending along the length. The exterior-facing surface may extend from a first edge of the lateral side in a substantially orthogonal direction. The structural member may include an interior-facing surface opposite the exterior-facing surface and extending from a second edge of the lateral surface. The framing assembly may include at least one insulation member secured to one or both of the exterior-facing surface and the interior-facing surface of the structural member. A width of each insulation member may substantially match a width of a respective one of the exterior-facing surface and the interior-facing surface.

21 Claims, 6 Drawing Sheets

COMPOSITE FRAMING MEMBER COMPRISING ELEMENTS THAT PROVIDE A THERMAL BREAK

FIELD OF INVENTION

The present technology relates to structural framing assemblies, and more particularly to the insulation of structural members through the use of thermal breaks.

BACKGROUND OF INVENTION

Regulating the thermal performance of buildings and structures is an important consideration in design and manufacture as to minimize temperature changes and reduce costs related to heating and cooling structure. Current methods use a variety of insulation types positioned within a cavity formed between the structural members of the frame, but fail to directly insulate the structural members themselves. Conventional structural members are often manufactured from material having high thermal transmittance and poor insulation properties, such as wood or metal, and may introduce a major source of heat transfer. Therefore, there is an interest in addressing potential heat transfer through the frame of various buildings and structures.

SUMMARY

The terms "invention," "the invention," "this invention" and "the present invention" used in this patent are intended to refer broadly to all of the subject matter of this patent and the patent claims below. Statements containing these terms should be understood not to limit the subject matter described therein or to limit the meaning or scope of the patent claims below. Embodiments of the invention covered by this patent are defined by the below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Embodiments of the present invention may encompass framing assemblies that may include a plurality of framing members that are coupled together to form a cavity. Each of the plurality of framing members may include a structural member. The structural member may include a lateral surface extending along a length of the structural member. The structural member may include an exterior-facing surface extending along the length of the structural member. The exterior-facing surface may extend from a first edge of the lateral side in a substantially orthogonal direction relative to the lateral surface. The structural member may include an interior-facing surface opposite the exterior-facing surface and extending from a second edge of the lateral surface. The framing assembly may include at least one insulation member secured to one or both of the exterior-facing surface and the interior-facing surface of the structural member. A width of each insulation member may substantially match a width of a respective one of the exterior-facing surface and the interior-facing surface.

In some embodiments, the framing assemblies may include an external board coupled with the exterior-facing surface of at least some of the plurality of framing members and that at least partially covers the cavity. The framing assemblies may include an internal board coupled with the interior-facing surface of at least some of the plurality of framing members and that at least partially covers the cavity. Each insulation may include foam. The framing assemblies may include an insulation material disposed within the cavity. The insulation material may include at least one material selected from the group consisting of: spray foam insulation, pour in place insulation, an insulation batt, reflective insulation, radiant insulation, loose-fill insulation, and blown-in insulation. A thermal transmittance of the at least one insulation member may be less than about 0.1 BTU/hr-ft-° F. The at least one insulation member may include a first insulation member and a second insulation member. The first insulation member may be coupled with the exterior-facing surface. The second insulation member may be coupled with the interior-facing surface.

Some embodiments of the present technology may encompass structural framing members. The framing members may include a structural member. The structural member may include a lateral surface extending along a length of the structural member. The structural member may include an exterior-facing surface extending along the length of the structural member. The exterior-facing surface may extend from a first edge of the lateral side in a substantially orthogonal direction relative to the lateral surface. The structural member may include an interior-facing surface opposite the exterior-facing surface and extending from a second edge of the lateral surface. The framing members may include an insulation member secured to one or both of the exterior-facing surface and the interior-facing surface of the structural member. A width of the insulation member may substantially match a width of a respective one of the exterior-facing surface and the interior-facing surface.

In some embodiments, the insulation member may provide a thermal insulating performance of at least R-3 per inch. The insulation member may be secured to the structural member with a bond strength of at least 50 pounds per square inch. The insulation member may have a density between 1 lb/ft3 and 10 lb/ft3. The insulation member may be secured to the structural member using one or more adhesives. The insulation member may be secured to the structural member without adhesives or mechanical fasteners. The width of the insulation member may be within 20% of the width of the respective one of the exterior-facing surface and the interior-facing surface. The framing member may include at least one material selected from the group consisting of wood, engineered wood, oriented strand board, concrete, and steel.

Some embodiments of the present technology may encompass methods of manufacturing a structural framing member. The methods may include providing a structural member. The structural member may include a lateral surface extending along a length of the structural member. The structural member may include an exterior-facing surface extending along the length of the structural member. The exterior-facing surface may extend from a first edge of the lateral surface in a substantially orthogonal direction relative to the lateral surface. The structural member may include an interior-facing surface opposite the exterior-facing surface and extending from a second edge of the lateral surface. The methods may include adhering a foam insulation member to one or both of the exterior-facing surface and the interior-facing surface of the structural member. a width of the foam insulation member may substantially match a width of a respective one of the exterior-facing surface and the interior-facing surface.

In some embodiments, adhering the foam insulation may include applying uncured foam to one or both of the exterior-facing surface and the interior-facing surface of the structural member. Adhering the foam insulation may include curing the foam such that a tackiness of the foam adheres the foam to the structural member without use of adhesives or mechanical fasteners. Adhering the foam insulation may include applying an adhesive to one or both of the foam insulation member and the structural member. Adhering the foam insulation may include positioning the foam insulation member against the respective one of the exterior-facing surface and the interior-facing surface. Applying the adhesive may include at least one action selected from the group consisting of spraying the adhesive, roll-coating the adhesive, and applying a bead of the adhesive. The methods may include applying pressure to one or both of the foam insulation member and the structural member after positioning the foam insulation member against the respective one of the exterior-facing surface and the interior-facing surface.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Figure 1:
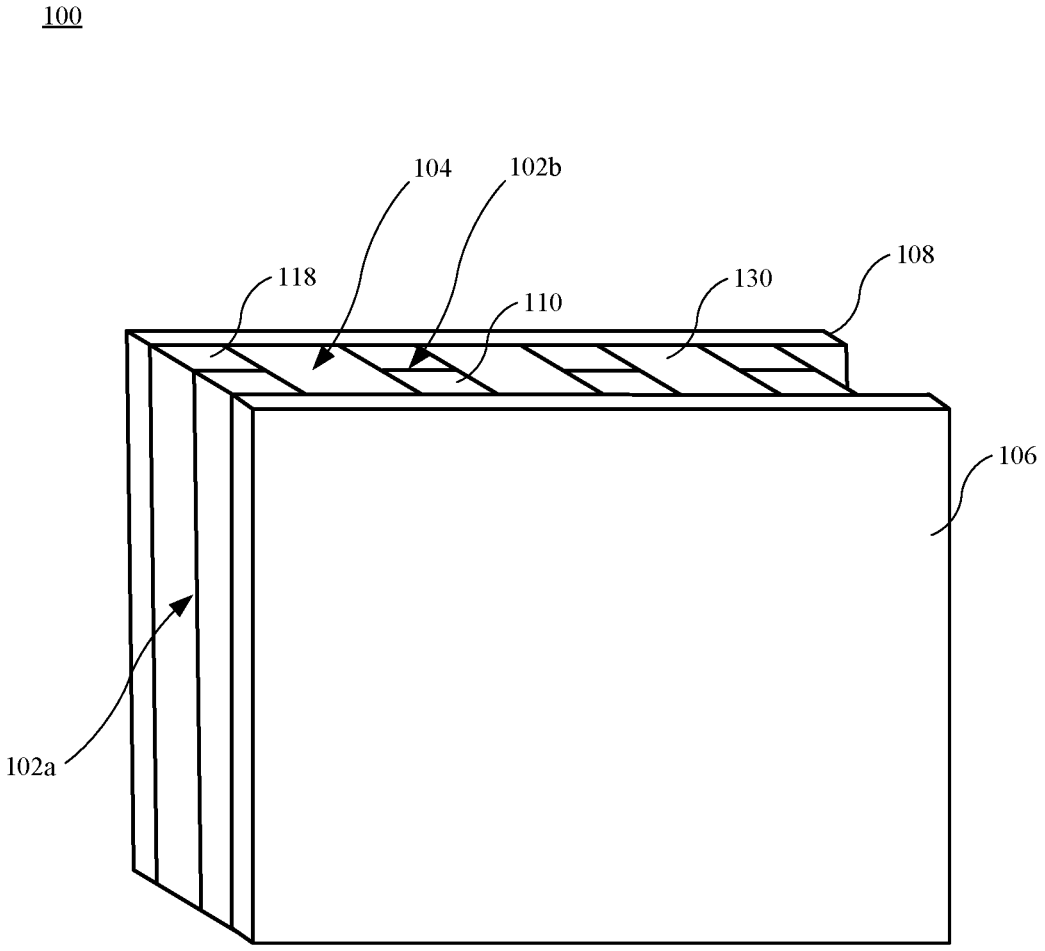
FIG. 1 illustrates a perspective view of a framing assembly in accordance with the present disclosure.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following description, positional terms like "above," "below," "vertical," "horizontal,", "bottom," "top," and the like are sometimes used to aid in explaining and specifying features illustrated in the drawings as presented, that is, in the orientation in which labels of the drawings read normally.

Embodiments of the present invention are directed to insulated framing members and methods of manufacturing such framing members. Embodiments of the insulated framing members may include structural members (such as framing boards) that include an insulating member, such as foam, on the exterior-facing and/or interior-facing surface of the structural member. Such insulating framing members may help insulate the structural members of a framing assembly to reduce the amount of heat transfer through the structural members. Embodiments may provide this additional level of insulation without the need to use insulation boards that extend over and cover all or a portion of a cavity defined by the framing members, which may help reduce the amount of materials needed to prevent heat transfer through the structural members. Additionally, embodiments may provided increased thickness relative to conventional framing members, which may provide deeper cavities that may accommodate higher volumes of more cost effective cavity insulation. This may enable the total insulation level of the structure to be improved.

FIG. 1 depicts a perspective view of a framing assembly 100. The framing assembly 100 may generally include a number of framing members 102 coupled together to form one or more cavities 104, an external layer 106, and/or an internal layer 108. As shown in both FIG. 1 and in FIG. 2, which depicts a cross-sectional view of the framing assembly 100, a number of framing members 102 may be spaced apart and coupled together to form a frame. For example, two or more vertical framing members 102 may be arranged in a generally parallel manner, with two or more horizontal framing members 102 being coupled to the vertical framing members 102 to define one or more cavities. While illustrated with a number of framing members 102 being coupled to form generally rectangular framing assemblies 100 and/or cavities 104, it will be appreciated that the framing members 102 may be arranged to form any shape of framing assemblies 100 and/or cavities 104. Additionally, while illustrated with linear framing members 102, one or more of the framing members 102 may be curved in some embodiments. The external layer 106 may be positioned at and secured to an exterior surface of some or all of the framing members 102 and may span across at least a portion of one or more of the cavities 104 to enclose a side of the cavity 104. The internal layer 108 may be positioned opposite the external layer 106 and may be secured to the framing members 102. Similarly to the external layer 106, the internal layer 108 may span across at least a portion of one or more of the cavities 104 to enclose a side of the cavity 104. The framing assembly 100 as shown may be used in the construction or manufacture of a variety of structures, and is configured as to provide for a reduced thermal transmittance compared to framing assemblies known in the art. It is envisioned within the scope of this application that the framing assembly 100 may be combined with other framing elements. In addition, the framing assembly 100 is shown in a rectangular configuration in FIGS. 1-4, however, this is merely exemplary, and a variety of shapes and configuration are envisioned within the scope of this detailed description.

Figure 2:
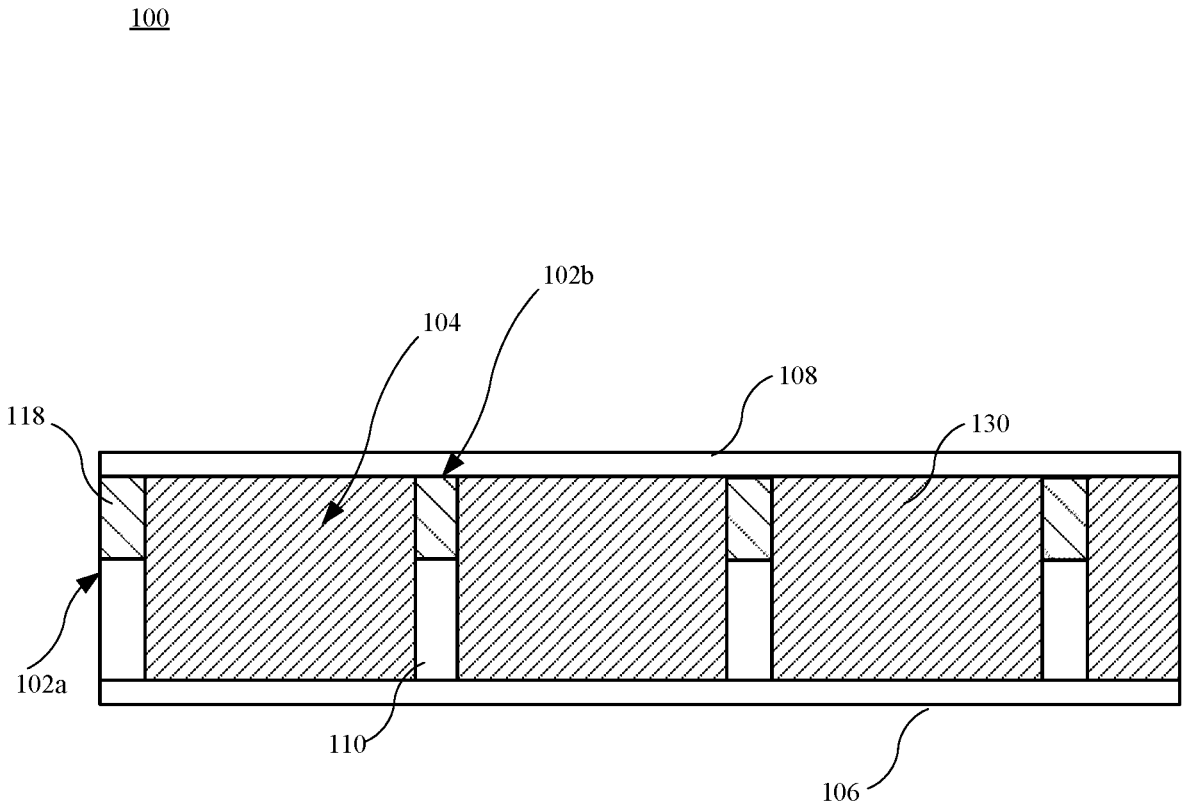
FIG. 2 illustrates a cross-sectional view of the framing assembly of FIG. 1.
Figure 3B:
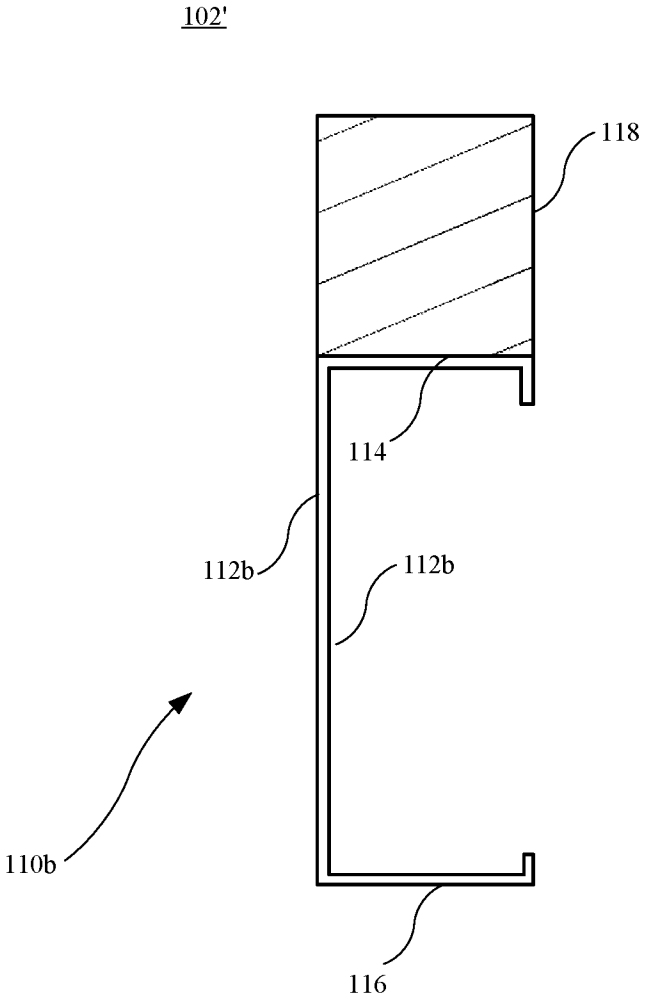
FIG. 3B illustrates a top plan view of a framing member in accordance with the present disclosure.
Figure 3A:
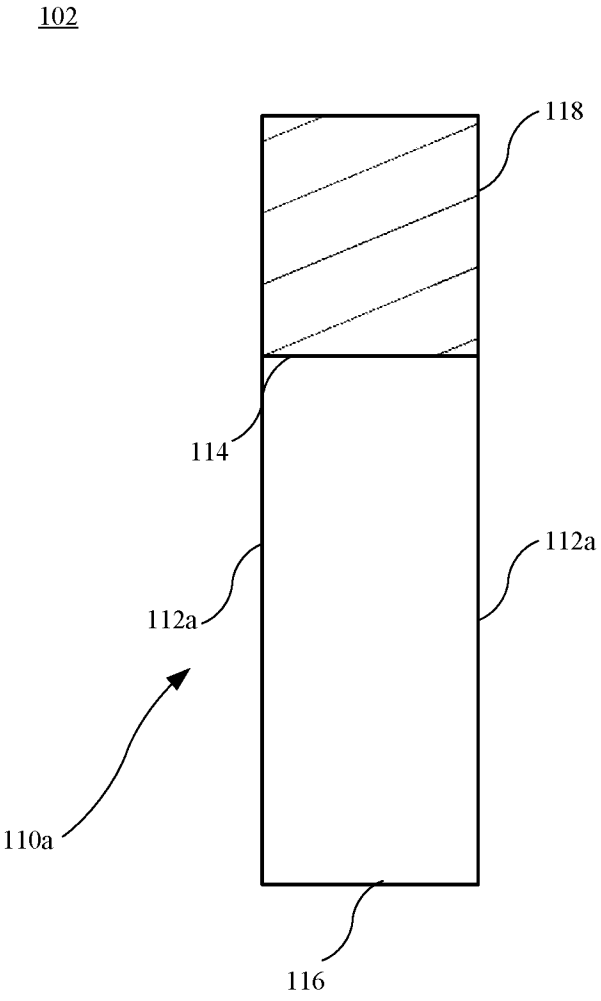
FIG. 3A illustrates a top plan view of a framing member in accordance with the present disclosure.
Figure 3C:
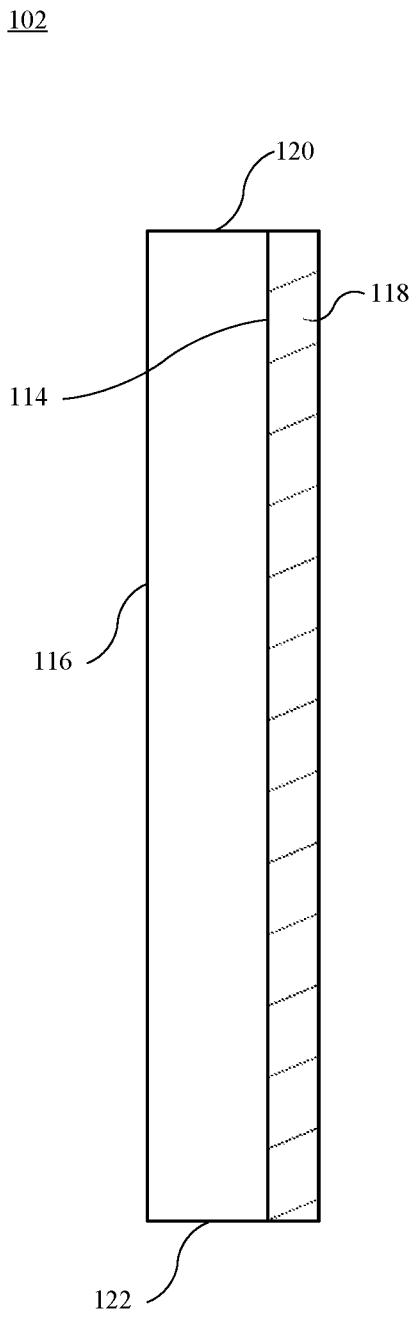
FIG. 3C illustrates a side elevation view of a framing member in accordance with the present disclosure.

As shown generally in FIGS. 1 and 2, and more particularly in FIG. 3, each framing member 102 include a structural member 110 and at least one insulation member 118. The structural member 110 may provide structure to the framing assembly 100. For example, the structural member may be a construction framing board or beam, such as a wood (e.g., 2×4, 2×6, etc.), engineered wood, oriented strand board (OSB), concrete, and/or steel (e.g., cold pressed steel) board or beam that may be used to provide structural and/or load bearing support for a structure, such as a wall. As best illustrated in FIGS. 3A-3C, the structural member 110 may include at least one lateral surface 112 that extends along a length of the structural member and couples a first end 120 and a second end 122. For example, each structural member may include two lateral surfaces 112 that are positioned opposite one another. In some embodiments (such as those involving wood and/or OSB boards), the two lateral surfaces 112*a* may be spaced apart from one another by a full thickness of the structural member 110*a* as shown in FIG. 3A. In other embodiments (such those involving steel beam), the two lateral surfaces 112*b* may be proximate one another and less than a full thickness of the structural member 110*b* as shown in the framing member 102' shown in FIG. 3B. The structural member 110 may include an exterior-facing surface 114 extending along the length of the structural member 110. The exterior-facing surface 114 may extend from a first edge of one of the lateral surfaces 112, such as in a substantially orthogonal direction relative to the lateral surface 112. The structural member 110 may include an interior-facing surface 116 opposite the exterior-facing surface 114. The interior-facing surface 116 may extend from a second edge of the lateral surface 112 and may also be substantially orthogonal to the lateral surface 112. The exterior-facing surface 114 and interior-facing surface 116 may define a width of the structural member 110, while the lateral surfaces 112 may define a thickness of the structural member 110 (and a portion of a depth of a resulting cavity 104). As just one example, when the structural member 110 is a 2×4, the lateral surfaces 112 may define a side that is approximately 3.5 inches thick, while the exterior-facing surface 114 and interior-facing surface 116 may each define a side that is approximately 1.5 inches wide. In embodiments in which the two lateral surfaces 112*a* are spaced apart from one another by a full thickness of the structural member 110*a*, each of the exterior-facing surface 114 and the interior-facing surface 116 may each extend a full width of the structural member 110 between and couple the opposing lateral surfaces 112. In other embodiments (such as those using certain steel beam designs), one end of each of the exterior-facing surface 114 and the interior-facing surface 116 may extend away from the lateral surfaces 112 and may not couple with either lateral surface 112. The exterior-facing surface 114 may face an exterior of a structure, while the interior-facing surface 116 may face an interior side of the structure.

The structural members 110 may be coupled with other structural members to form at least a portion of the framing assembly 100 using a variety of coupling tools such as mechanical fasteners and/or adhesives. The structural members 110, as shown in FIG. 1 and FIG. 2, are positioned vertically, however, this is merely exemplary, and a variety of configurations and orientations are envisioned within the scope of this application.

As noted above, each structural member 110 may be coupled with one or more insulation members 118, which may help insulate the structural members 110 and reduce heat transfer through the structural members 110 of a given framing assembly 100. For example, the addition of the insulation member 118 to the structural member creates a thermal break between the exterior of the framing assembly 100 and the structural member 110 as to reduce the transmission of temperature. Each insulation member 118 may be positioned at and secured to the exterior-facing surface 114 or the interior-facing surface 116 of the structural member 110 to insulate the respective surface. While shown with framing member 102 including only a single insulation member 118 (e.g., either on the exterior-facing surface 114 or the interior-facing surface 116 of the structural member 110), it will be appreciated that in some embodiments multiple insulation members 118 (e.g., at least one insulation member 118 on each of the exterior-facing surface 114 and the interior-facing surface 116 of the structural member 110) may be used in some embodiments. In embodiments with multiple insulation members 118, each insulation member 118 may be identical, or may have different makeups and/or structures (e.g., different chemical composition and/or dimensions). Additionally, in some embodiments a single surface (e.g., the exterior-facing surface 114 or the interior-facing surface 116 of the structural member 110) may include multiple insulation members 118 provided as different layers stacked atop one another.

Each insulation member 118 may include an insulation material, such as an insulating foam, or non-foam material. For example, the insulating foam may include a polyisocyanurate foam, a polyurethane foam, a polystyrene foam, a phenolic foam, and/or other type of foam. Non-foam insulating members may include fiberglass, mineral fiber, wood fiber, polyester fiber, or other materials made from natural or synthetic fibers. In some embodiments, the insulation member 118 may have a density of between about 1 lb/ft$^3$ and 10 lb/ft, between about 2 lb/ft$^3$ and 9 lb/ft$^3$ between about 3 lb/ft$^3$ and 8 lb/ft$^3$, between about 4 lb/ft$^3$ and 7 lb/ft$^3$, or between about 5 lb/ft$^3$ and 6 lb/ft$^3$. The insulation member 118 may have an R-value of at least about R-3 per inch, at least about R-4 per inch, at least about R-5 per inch, at least about R-6 per inch, or greater.

The insulating member 118 may include an insulating strip that has a width that is substantially the same as a width of the exterior-facing surface 114 and/or the interior-facing surface 116. For example, the width of the insulating member 118 may be within about 20%, within about 15%, within about 10%, within about 5%, within about 3%, within about 1%, or less of the width of the exterior-facing surface 114 and/or the interior-facing surface 116. In some embodiments, the insulating member 118 may be centered about the exterior-facing surface 114 and/or the interior-facing surface 116 such that the insulating member 118 substantially covers (or extends slightly beyond one or both edges of) the exterior-facing surface 114 or the interior-facing surface 116 to provide thermal insulation to the structural member 110. A thickness of the insulating member 118 may be between about 0.5 inches and 5 inches, between or about 1 inch and 4.5 inches, between or about 1.5 inches and 4 inches, between or about 2 inches and 3.5 inches, or between or about 2.5 inches and 3 inches in various embodiments.

In some embodiments, the insulation member 118 may be coupled to the structural member 110 without the use of mechanical fasteners, although one or more mechanical fasteners may be used in some embodiments. For example, the insulation member 118 may be coupled with using one or more adhesives, such as (but not limited to) construction adhesives, polyurethane adhesives isocyanate adhesives, and/or acrylic adhesives, however, it is envisioned that other adhesives may be used. In some embodiments, the adhesive may be selected based on the materials used to form the structural member 110 and/or the insulation member 118 to ensure that the adhesive is capable of bonding the two materials together. To provide sufficient structural integrity as to reduce the possibility of failure and to increase the life span of the framing member 102, it is preferred that the minimum bond strength between the structural member 110 and the insulation member 118 is at least about 50 PSI, at least about 55 PSI, at least about 60 PSI, at least about 65 PSI, or more, as measured as tensile strength per ASTM C297. In some embodiments, the insulation member 118 and the structural member 110 may be coupled without the use of an adhesive or mechanical fasteners. For example, a tackiness of the foam itself may be sufficient to bond the two components together. As just one example, the foam may be applied to the structural member 110 in an uncured state (e.g., while tacky) and subsequently cured against the structural member 110 to secure the two components together.

Each cavity 104 may be defined by a number of framing members 102 coupled together to form a boundary of the cavity 104. For example, referring again to FIG. 1 and FIG. 2, an exemplary cavity 104 is shown between a first framing member 102*a* and a second framing member 102*b*. Atop and bottom framing member 102 (not shown) may be used to define the upper and lower boundaries of the cavity 104 in some embodiments. The dimensions of each cavity 104 may be dependent on the spacing between the various framing members 102, as well as a thickness (e.g., a combined thickness of the structural member 110 and insulation member 118) of each framing member 102. A plurality of uniform sized cavities 104 are shown in FIG. 1 and FIG. 2, however, it is envisioned that non-uniform configurations may be used. To provide greater insulation, the cavity 104 is often filled with an insulation material 130 such as spray foam insulation, pour-in-place foam insulation, batt and roll insulation, reflective insulation, radiant insulation, loose-fill insulation, and/or blown-in insulation. This insulation may be foam insulation, fiberglass insulation, cellulose insulation, wool insulation, and/or other forms of insulation. By incorporating framing members 102 that include insulation members 118, a depth of each of the cavities 104 may be increased relative to conventional framing members (e.g., 2×4s). This additional depth may accommodate a greater volume and thickness of cavity-filling insulation material, which may improve the overall level of insulation provided by the framing assembly 100. In some embodiments, such as those using spray foam and/or pour-in-place foam, once set, the additional insulation material within the cavity 104 may help improve the strength of the framing assembly 100.

As described above, one or more external layers 106, such as sheathing layers, may be positioned in contact with a plurality of framing members 102 and may extend across at least a portion of one or more cavities 104. As shown in FIG. 1 and FIG. 2, an exemplary external layer 106 is positioned against and secured to the insulation member 118 of at least some of the plurality of framing members 102. The external layer 106 may provide support a surface that accepts fasteners allowing for exterior elements such as siding, windows, doors, etc. to be secured to the framing assembly 100. Additionally, the external layer 106 may, but is not required to, provide additional structural support to the framing assembly 100. For example, in embodiments wherein the structural member 110 of the framing member 102 is wood, the external layer 106 may be used to provide additional strength. The external layer 106 may be made of a variety of materials including, but not limited to, wood-based products such as oriented strand board (OSB), gypsum boards, glass mats, and/or cement boards.

One or more internal layers 108 may be positioned in contact with the plurality of framing members 102 as to extend across an opposing side of at least a portion of one or more cavities 104 relative to the external layer 106. As shown in FIG. 1 and FIG. 2, an exemplary internal layer 108 may be positioned against the structural member 110 (e.g., the interior-facing surface 116) of each of the plurality of framing members 102. The internal layer 108 may be secured to the structural member 110 in a variety of fashions including mechanical fasteners, adhesives, welding, or other methods known in the art. Depending on the application and the situation, the internal layer 108 may be constructed of drywall, wood, metal, or other materials that may be typically used. The internal layer 108 is shown as coupled to the structural member 110 of the framing member 102, however, this is merely exemplary and it is envisioned that the structural member 110 may be coupled with an insulation member 118 in some embodiments.

Figure 4:
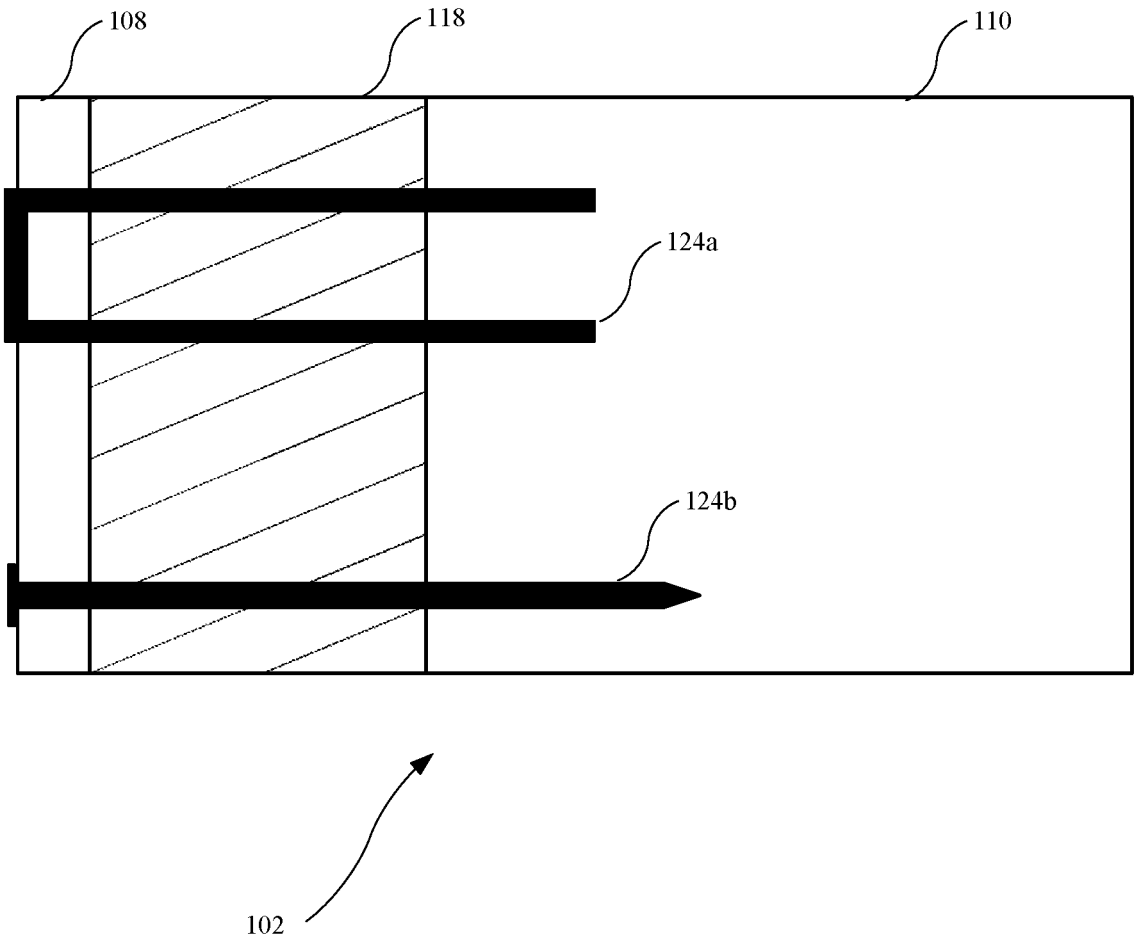
FIG. 4 illustrates a cross-section view of an exterior layer coupled with a framing member in accordance with the present disclosure.

Now referring to FIG. 4, a cross-sectional view of a portion of the external layer 106 coupled to a framing member 102 is depicted. In particular, the external layer 106 may be coupled with the structural member 110 using a mechanical fastener 124 (e.g., a staple 124*a* or a nail 124*b*) which may extend from the external layer 106, through the insulation member 118, and into the structural member 110 to secure the components together. While not illustrated, the internal layer 108 may be secured to a framing member 102 in a similar manner.

The use of framing members 102 that include insulation member 118 and structural members 110 may result in a framing assembly 100 having an improved thermal transmittance of less than about 0.1 Btu/hr-ft$^2$-° F., less than about 0.09 Btu/hr-ft$^2$-° F., less than about 0.08 Btu/hr-ft$^2$-° F., less than about 0.07 Btu/hr-ft$^2$-° F., less than about 0.06 Btu/hr-ft$^2$-° F., less than about 0.05 Btu/hr-ft$^2$-° F., less than about 0.04 Btu/hr-ft$^2$-° F., or less. In a particular embodiment in which a framing assembly 100 includes framing members 102 spaced 16 inches on-center and utilizes foam insulation members 118 that are between 1 inch and 2 inches thick in combination with a non-foam cavity insulation material that provides insulating performance (in terms of thermal resistance) of at least R-3.2 per inch (and preferably in the range of R-3.2 to R-4.2 per inch), the framing assembly 100 may provide thermal transmittance (U-factors) between 0.06 and 0.042 Btu/hr-ft$^2$-° F. In a particular embodiment in which a framing assembly 100 includes framing members 102 spaced 16 inches on-center and utilizes foam insulation members 118 that are between 0.5 inches and 2 inches thick in combination with a closed-cell foam plastic cavity insulation material of between 1 and 4 inches thick (with the remaining cavity space insulated with other insulation materials (e.g., fiberglass, cellulose, etc.)), the framing assembly 100 may provide thermal transmittance (U-factors) between 0.057 and 0.037 Btu/hr-ft$^2$-° F.

Figure 5:
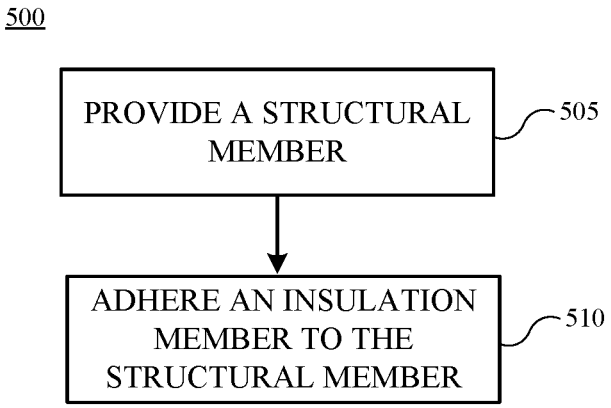
FIG. 5 is a flowchart illustrating a process of manufacturing a frame member in accordance with the present disclosure.

FIG. 5 is a flowchart illustrating a process 500 for manufacturing a structural framing member according to some embodiments of the present invention. The process 500 may be used to produce framing members, such as framing members 102 described in relation to FIGS. 1-4. Process 500 may include providing a structural member (such as structural member 110) at operation 505. For example, the structural member may include at least one lateral surface extending along a length of the structural member, an exterior-facing surface extending along the length of the structural member, and/or an interior-facing surface opposite the exterior-facing surface and extending from a second edge of the lateral surface. The structural member may be formed of wood, OSB, steel, and/or other material.

At operation 510, a foam insulation member may be adhered to one or both of the exterior-facing surface and the interior-facing surface of the structural member. For example, in some embodiments, an uncured foam may be applied to one or both of the exterior-facing surface and the interior-facing surface of the structural member. The foam may be cured against the structural member such that a tackiness of the foam adheres the foam to the structural member without use of adhesives or mechanical fasteners. In other embodiments, one or more adhesives m ay be applied to an existing foam insulation member and/or the structural member. For example, the adhesive may be sprayed, roll-coated, applied as a bead, and/or otherwise applied to the foam insulation member and/or the structural member. The foam insulation member may then be positioned against a respective one of the exterior-facing surface and the interior-facing surface of the structural member to adhere the components together. In some embodiments, heat and/or pressure may be to the foam insulation member and/or the structural member after positioning the foam insulation member against the respective one of the exterior-facing surface and the interior-facing surface to help adhere the components. For example, one or more rollers, presses, and/or other mechanisms may be used to apply pressure to one or both components to improve the bond of the adhesive. In some embodiments, fans, ovens, and/or other curing devices may be used to circulate air and/or heat the foam insulation member and/or the structural member to cure the adhesive. The process described herein may be performed at either a factory or at a construction site and may be used to create pre-assembled panels or whole building modules.

The various aspects, embodiments, implementations, or features of the described embodiments can be used separately or in any combination. In particular, it should be appreciated that the various elements of concepts from FIGS. 1-5 may be combined without departing from the spirit or scope of the invention.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure. It will be further appreciated that all testing methods described here may be based on the testing standards in use at the time of filing or those developed after filing.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or +10%, 5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, 5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A framing assembly comprising:

a plurality of framing members that are coupled together to form a cavity, each of the plurality of framing members comprising:

a structural member comprising:

a lateral surface extending along a length of the structural member;

an exterior-facing surface extending along the length of the structural member, the exterior-facing surface extending from a first edge of the lateral side in a substantially orthogonal direction relative to the lateral surface; and an interior-facing surface opposite the exterior-facing surface and extending from a second edge of the lateral surface;

at least one insulation member secured to one or both of the exterior-facing surface and the interior-facing surface of the structural member, wherein a width of each insulation member substantially matches a width of a respective one of the exterior-facing surface and the interior-facing surface; and an adhesive that bonds the at least one insulation member to the one or both of the exterior-facing surface and the interior-facing surface of the structural member, the adhesive having a different composition than the at least one insulation member.

2. The framing assembly of claim 1, further comprising:
an external board coupled with the exterior-facing surface of at least some of the plurality of framing members and that at least partially covers the cavity; and
an internal board coupled with the interior-facing surface of at least some of the plurality of framing members and that at least partially covers the cavity.

3. The framing assembly of claim 1, wherein:
each insulation member comprises foam.

4. The framing assembly of claim 1, further comprising:
an insulation material disposed within the cavity.

5. The framing assembly of claim 4, wherein:
the insulation material comprises at least one material selected from the group consisting of: spray foam insulation, pour in place insulation, an insulation batt, reflective insulation, radiant insulation, loose-fill insulation, and blown-in insulation.

6. The framing assembly of claim 1, wherein:
a thermal transmittance of the at least one insulation member is less than about 0.1 BTU/hr-ft-° F.

7. The framing assembly of claim 1, wherein:
the at least one insulation member comprises a first insulation member and a second insulation member;
the first insulation member is coupled with the exterior-facing surface; and
the second insulation member is coupled with the interior-facing surface.

8. A structural framing member, comprising:
a structural member comprising:
a lateral surface extending along a length of the structural member;
an exterior-facing surface extending along the length of the structural member, the exterior-facing surface extending from a first edge of the lateral side in a substantially orthogonal direction relative to the lateral surface; and
an interior-facing surface opposite the exterior-facing surface and extending from a second edge of the lateral surface; and
an insulation member secured to one or both of the exterior-facing surface and the interior-facing surface of the structural member, wherein a width of the insulation member substantially matches a width of a respective one of the exterior-facing surface and the interior-facing surface; and
an adhesive that bonds the insulation member to the one or both of the exterior-facing surface and the interior-facing surface of the structural member, the adhesive having a different composition than the insulation member.

9. The structural framing member of claim 8, wherein:
the insulation member comprises a thermal insulating performance of at least R-3 per inch.

10. The structural framing member of claim 8, wherein:
the insulation member is secured to the structural member with a bond strength of at least 50 pounds per square inch.

11. The structural framing member of claim 8, wherein:
the insulation member has a density between 1 $lb/ft^3$ and 10 $lb/ft^3$.

12. The structural framing member of claim 8, wherein:
the insulation member is secured to the structural member without mechanical fasteners.

13. The structural framing member of claim 8, wherein:
the width of the insulation member is within 20% of the width of the respective one of the exterior-facing surface and the interior-facing surface.

14. The structural framing member of claim 8, wherein:
the framing member comprises at least one material selected from the group consisting of wood, engineered wood, oriented strand board, concrete, and steel.

15. A method of manufacturing a structural framing member, comprising:
providing a structural member comprising:
a lateral surface extending along a length of the structural member;
an exterior-facing surface extending along the length of the structural member, the exterior-facing surface extending from a first edge of the lateral surface in a substantially orthogonal direction relative to the lateral surface; and
an interior-facing surface opposite the exterior-facing surface and extending from a second edge of the lateral surface; and
adhering a foam insulation member to one or both of the exterior-facing surface and the interior-facing surface of the structural member using an adhesive, wherein:
a width of the foam insulation member substantially matches a width of a respective one of the exterior-facing surface and the interior-facing surface; and
the adhesive has a different composition than the foam insulation member.

16. The method of manufacturing a structural framing member of claim 15, wherein:
adhering the foam insulation comprises:
applying the adhesive to one or both of the foam insulation member and the structural member; and
positioning the foam insulation member against the respective one of the exterior-facing surface and the interior-facing surface.

17. The method of manufacturing a structural framing member of claim 16, wherein:
applying the adhesive comprises at least one action selected from the group consisting of spraying the adhesive, roll-coating the adhesive, and applying a bead of the adhesive.

18. The method of manufacturing a structural framing member of claim 16, further comprising:
applying pressure to one or both of the foam insulation member and the structural member after positioning the foam insulation member against the respective one of the exterior-facing surface and the interior-facing surface.

19. A method of manufacturing a structural framing member, comprising:
providing a structural member comprising:
a lateral surface extending along a length of the structural member;
an exterior-facing surface extending along the length of the structural member, the exterior-facing surface extending from a first edge of the lateral surface in a substantially orthogonal direction relative to the lateral surface; and
an interior-facing surface opposite the exterior-facing surface and extending from a second edge of the lateral surface;

forming a foam insulation member integrally to one or both of the exterior-facing surface and the interior-facing surface of the structural member, wherein:

a width of the insulation member substantially matches a width of a respective one of the exterior-facing surface and the interior-facing surface; and the foam insulation member comprises at least one of a polyisocyanurate foam, a polystyrene foam, or a phenolic foam; and bonding the insulation member to the structural member by at least one process selected from the group consisting of pouring, spraying, or extruding.

20. The method of manufacturing a structural framing member of claim 19, wherein:

the insulation member is secured to the structural member without adhesives or mechanical fasteners.

21. The method of manufacturing a structural framing member of claim 18, wherein:

the pressure is applied using one or both of a roller and a press.

* * * * *